United States Patent [19]

Bidwell

[11] 4,448,348

[45] May 15, 1984

[54] FORCED AIR FLUE HEATER DEVICE

[76] Inventor: Malcolm A. Bidwell, 30138 Lilac Rd., Valley Center, Calif. 92082

[21] Appl. No.: 409,667

[22] Filed: Aug. 19, 1982

[51] Int. Cl.[3] ..... F24B 7/00

[52] U.S. Cl. ..... 237/55; 165/184; 165/DIG. 2

[58] Field of Search ..... 126/99 A, 99 C, 99 D; 165/DIG. 2, 184; 237/55

[56] References Cited

U.S. PATENT DOCUMENTS

| | | | |
|---|---|---|---|
| 542,650 | 7/1895 | Mingus | 237/55 |
| 2,468,909 | 5/1949 | Yeager | 237/55 |
| 2,619,022 | 11/1952 | Hergenrother | 237/55 |
| 4,147,303 | 4/1979 | Talucci | 237/55 |
| 4,300,527 | 11/1981 | Montague | 165/DIG. 2 |
| 4,381,819 | 5/1983 | Paolino | 237/55 |

FOREIGN PATENT DOCUMENTS

| | | | |
|---|---|---|---|
| 605845 | 2/1925 | France | 165/DIG. 2 |

*Primary Examiner*—Daniel J. O'Connor

[57] ABSTRACT

This device is a heat capturing, recirculating economizer ventilator, which is sheet metal and is in kit form, to be assembled by the user, for being applied to standing-fireplaces, stoves, and the like. Primarily, it consists of a housing encapsulating a segmented helical configuration surrounding a vertical smooth flue pipe, which automatically forces room ambient air by virtue of a motor driven centrifugal blower, spirally downward on a double path toward and through diffusers, for the purpose of distributing heated air into a space to be heated.

1 Claim, 7 Drawing Figures

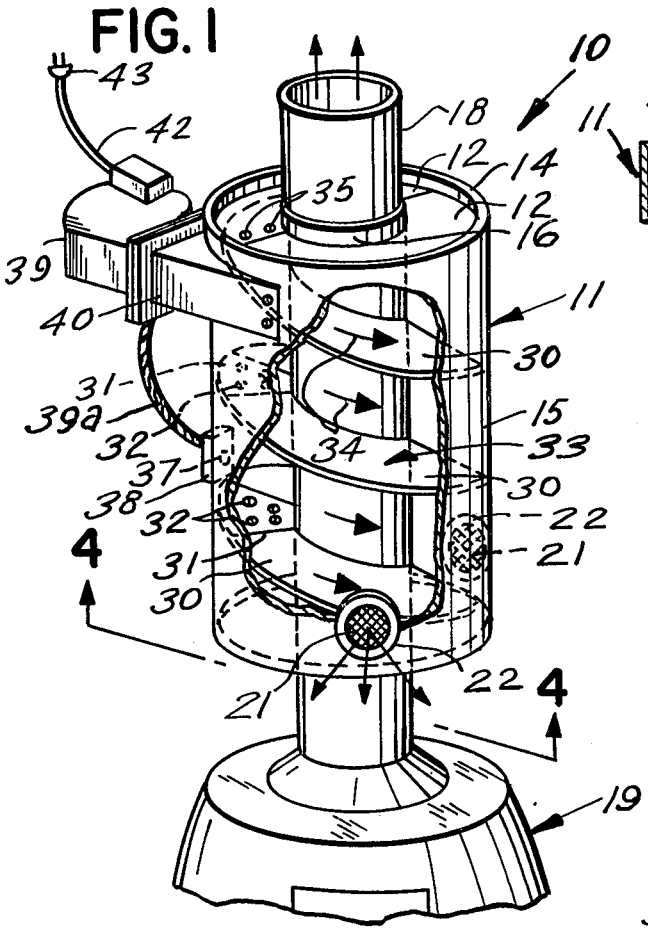
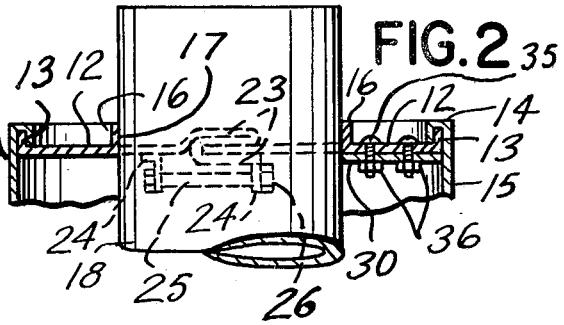
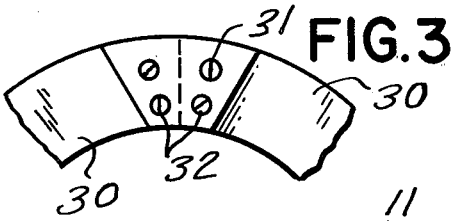
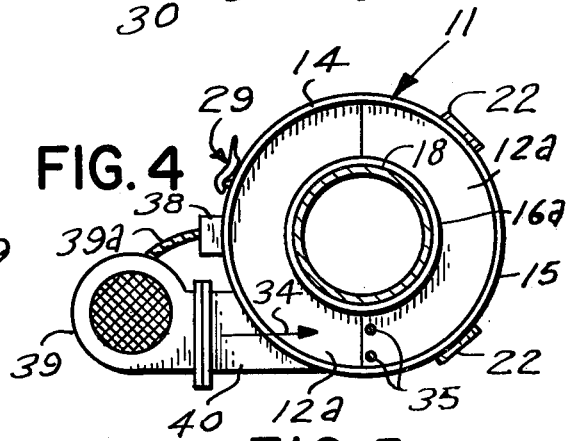
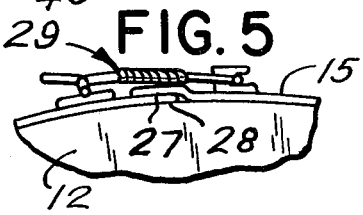
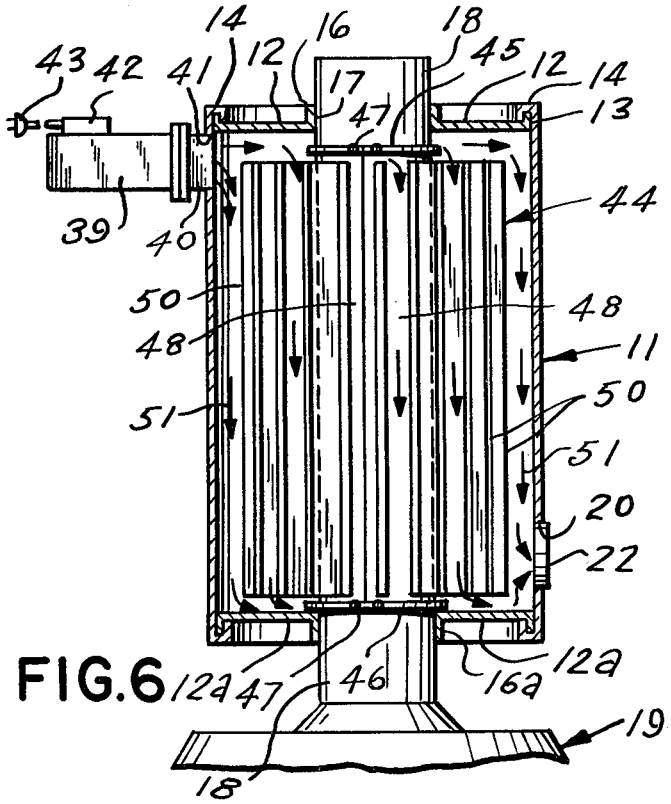
FIG. 6
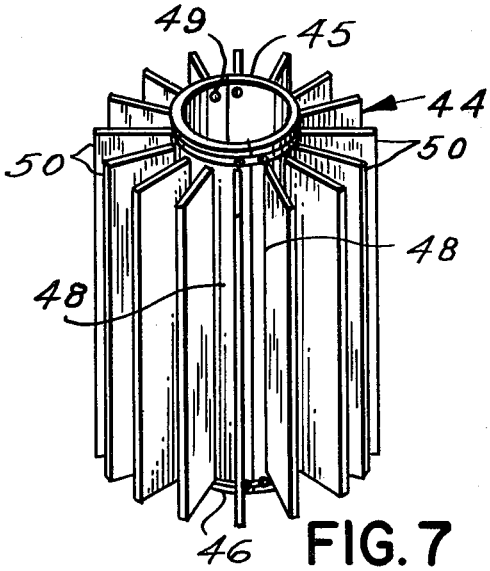
FIG. 7

FORCED AIR FLUE HEATER DEVICE

This invention relates to wood burning free-standing fireplaces, stoves and the like, and more particularly, to a forced air flue heater device.

The principal object of this invention is to provide a forced air flue heater device, which will be an easily assembled kit, that will capture and put to use, some of the heat that would normally be wasted as it rises up and exits a flue pipe of a wood burning fireplace, a stove, etc.

Fuel pipes of standard dimensional sizes connected to wood burning free-standing fireplaces, stoves and the like, extend sectionally upward, penetrating in some instances, ceilings, attics, roof sections, and beyond, for the necessary adjunct to convection flow for draft draw, and for the means of discharging and removal of heated smoke and gases to the outside atmosphere. Usually, single walled sections of smooth sheet metal flue pipes exist with the heated space, and insulated double walled sections penetrate combustiable areas extending through floors, attics and roofs, and much heat on its ascent, conducts through the lower single walled sections.

Another object of this invention is to provide a forced air flue heater device, which will retrieve a portion of this flue gas heat in a simple encapsulating manner, and eliminates removal of flue pipe sections, to accomplish the retrieving and utilization of wasted heat. In other words, similar economizing devices of the art, necessitate removal of flue pipe sections for insertion of those devices. Section removal is not necessary in this invention, and routing of flue gases or air flow baffling, is also eliminated, as well as large inefficient propeller fans and motors.

Another object of this invention is to provide a forced air flue heater device, which will retrieve optimum heat, distribute it effectively by means of electricity, using a centrifugal blower to produce air velocity pressure.

A further object of this invention is to provide a forced air flue heater device, which will be of such construction, that the flue gases are free-flow through an encapsulated plenum, the air at velocity being forced along a counter downward circular double helical path, continually absorbing convected heat, then discharging the air through strategically placed diffuser openings into the space receiving heat, normally a living space. The present invention diffuses air advantageously with stoves or the like, near perimeter walls, or in corners of rooms, for optimum air flow distribution, and being unobjectionable to occupants of the living space. The ambient space air is also continually and automatically heated and recirculated.

A still further object of this invention is to provide a forced air flue heater device, which will be of such construction, that the delivery of recirculated air encased in a housing, will be forced along a double helix path, which also acts as a heat dissipation, making a metal physical contact radially with the longitudinal exterior of the flue walls in its circular-helical descent, attracting measures of thermal units of heat, prior to room delivery, and ambient room air entering the suction side of a motor driven blower fan, which operates automatically by use of an electrical temperature switch with adjustable setting range, forces air toward the end of an upper affixed helix segment, causing the air mass to be spilt, or creating a double path downwardly and circularly between the flue pipe's outer helical and attached member.

An even further object of this invention is to provide a forced air flue heater device, which will be safe in operation.

Other objects are to provide a forced air flue heater device which is simple in design, inexpensive to manufacture, rugged in construction, easy to use, and efficient in operation.

These, and other objects, will be readily evident upon a study of the following specification, and the acacompanying drawing, wherein FIG. 1 is a perspective view of the present invention, shown partly broken away;

FIG. 2 is an enlarged fragmentary and elevational view of FIG. 1;

FIG. 3 is a fragmentary top plan view, of one of the helical splice portions of the invention;

FIG. 4 is a transverse view, taken along the line 4—4 of FIG. 1;

FIG. 5 is a fragmentary top plan view, showing the fastener devices for the encapsulationg housing of the invention;

FIG. 6 is vertical front view of FIG. 1, shown in section, and illustrating a modified form of inner core, and FIG. 7 is a perspective view of the core member of FIG. 6, shown removed therefrom.

According to this invention, a device 10 is shown to include a hollow clylindrical housing 11 of suitable sheet metal, is shown to include a top pair of semi-circular plates 12, having a lip 13 on their arcuate peripheral edges, which engage with the inner space of an open lip 14, which terminates the ends of housing 11, that consits of a preformed and elongated sheet of metal 15. A centrally disposed inner flange 16 of the pair of plates 12, defines an opening 17, in which is received the existing flue pipe 18 of a free-stand fireplace 19, stove, or the like. A pair of radially spaced-apart openings 20 through sheet of metal 15, include a wire mesh screen 21, which is held in place by a ring 22 suitably secured thereto, and openings 20 are provided for a purpose, which hereinafter will be describe. Plates 12 include inter-locking edges 23 and lugs 24 are also fixedly secured thereto, which receive bolt fasteners 25, that receive a nut fastener 26, for tightening the flange 16 to the outer periphery of flue pipe 18. A pair of semi-circular bottom plates **12*a* are fabricated in the same manner, as the above described plated 12, and plates 12*a* include a similar lip 16*a*, which engages the outer periphery of flue pipe 18, for an air tight fit on flue pipe 18, and one of the free ends 27 of metal 15 of housing 11, is formed, so as to overlap its opposite end 28, thereof. A pair of locking devices 29, which are common in the art, are secured in a spaced-apart longitudinal arrangement on the ends 27 and 28 of housing 11, and the helix metal section members 30, which are three in number, are semi-circular in configuration, and rejoined together by arcuate splice plates 31, which are secured thereto, by means of suitable fasteners 32, to form a helix member 33, and it should be noted, that the inside and outside diameters of helix member 33 are larger on the inside and the outside, than the diameters of the top wall and bottom wall of housing 11, which are defined by the respective plates 12 and 12*a*, and the outer peripheral edge of helix member 33 engages with the inner peripheral surface of housing 11, which is defined by the sheet metal 15. The configuration of the helix member 33 is also placed on the flue pipe 18, so as to create a counter clock-wise air flow, which is indicated by the arrows 34, as shown in FIG. 1 of the drawing, and the uppermost helix section 30 is secured at its end, to one of the plates 12, by suitable fasteners 35 and 36**.

An opening 37 through housing 11 has received therein, the sensor portion of a thermostat 38, which is suitably secured to the outside of housing 11, and is connected to a blower 39 by a cable 39*a*. Blower 39 is secured by a duct 40, over the upper opening 41, through housing 11, and a cord 42 with a plug 43 enables the blower 39 to be plugged into a suitable outlet receptacle.

In use, the device 10 as a kit, is assembled easily with household tools, and the removal of flue pipe 18 is not necessary.

With a reference mark inscribed on the surface of the vertical flue pipe 18, a measured distance vertically from the top surface of the aformentioned fireplace or stove 19, the top plates 12 are then secured to flue pipe 18 by tightening the nut fasteners 26 on bolt fasteners 25, thus forming the top wall of the housing 11. The helix section members 30 are then placed loosely around the existing flue pipe 18, which is accomplished by grasping each at their ends and bending these ends in opposite directions, sufficiently to pass them over the flue pipe 18. After the above is accomplished, the uppermost helix sections member 30 is lifted vertically by one end, and is secured to one of the upper plates 12 by the fasteners 35, as is more clearly illustrated in Figure of the drawing, When this uppermost section member 30 is secured to a plate 12, its opposite end will depend loosely downward, and the intermediate section member is raised and one end is secured to the uppermost section member 30, by a splice plate 31, through the use of fasteners 32, which is more clearly illustrated by FIG. 3. As viewed from the top of the structure, the helix section members 30 will be in the counter clockwise direction toward the fireplace or stove 19, as in seen in FIG. 1. The bottommost helix section member 30 is assembled, as was the intermediate section member 30, thus forming a loose fitting helix member 33, by the force of gravity giving it its spiral configuration around the flue pipe 18.

With the helix member 33, thus formed, the bottom plates 12*a* are loosely secured to the flue pipe 18, at a measured vertical reference point inscribed on flue pipe 18, which should be approximately the longitudinal length of the housing 11. The loose end of the bottom section member 30 is then secured to one of the bottom plates 12*a*, in the same abovementioned manner, as the uppermost section member 30 was secured to a top plate 12. For the inside peripheral edges of helix member 33 to contact the flue pipe 18 longitudinally, the sections 30 are physically stretched out, until the lower section member 30 meets the aformentioned reference mark established on the flue pipe 18, and the nuts fasteners 26 are tightened, thus securing the bottom plates 12*a* permanently to the vertical flue pipe 18. The metal sheet 15 is then secured on the plates 12 and 12*a*, by its longitudinal side edge lips 14 being received on the lips 13 of the plates 12 and 12*a* and the locking devices 29 are secured, so as to secure plate 15 together by its ends 27 and 28, which serve to encapsulate the helix member 33, forming an air tight plenum area.

It shall also be noted, that the position of the blower 39 is determined in relationship to the outer circumference edge of the upper helix section 30, because the entering air mass must be split or divided, forming a double path at this point of junction, and the blower mounting is such, that it will facilitate different size blowers 39, their ratings being in cubic feet per minutes, which varies with each flue heater model, as does its mounting surface dimensions.

The sensor portion of the thermostat is mounted in its opening of housing 11, so as to be in contact with the heat absorbing plenum air, and is at a measurable distance between the longitudinal length of the housing 11, at a point where a sensor penetration will not interfere with the outer peripheral edge of the helix member 33, and the thermostat 37 is adjustable within a range of degrees, as determined by the manufacturer.

For maximum heat exchange from the heat radiating helix member 33, the openings 20 with the mesh screens 21 are of careful consideration, as to size and placement with relationship to air velocity and diffusion of air into a space to be heated, so that regardless of the position of the fireplace 19 in the room optimum air distribution is accomplished. The openings 20 are also placed, so that the split volume mass of the heated air at any velocity within the plenum, will exit first at one, and then at the other diffuser opening 20.

It shall further be noted, that the prupose of the blower 39 is to ingress ambient room air, and force it into the plenum, giving it velocity pressure in a counterflow direction to the flue 18 gases, as indicated in FIG. 1 of the drawing, and the housing 11, with its helix 33, and the flue pipe 18, provide inherent rigidity for the assembly thereof.

It shall further be recognized, that an optional override switch may be located in the box of thermostat 38, to electrically by-pass the thermostat 38, for continuous blower 39 operation for non-heat ventilation during off-heat seasons.

Referring now to FIGS. 6 and 7 of the drawing, a modified core structure 44, is shown to include an upper clamp ring 45 and a lower clamp ring 46, which are secured to the outer periphery of flue pipe 18 by fasteners 47, which are common in the art. A pair of semi-circular and elongated members 48 serve as a sleeve, which is fastened together at the top and bottom by fastener means 49, and the ends of sleeve defined by members 48 are confined between the clamp rings 45 and 46. A plurality of equally and radially apaced vanes 50, which are fixedly secured to the outer periphery of members 48 in a suitable manner, provide for the downward flow of air pushed into housing 11 by the blower 39, which is indicated by the arrows 51.

In use, the vanes 48 and its sleeve combination serve as a heat transfer device for taking heat from the flue pipe 18, in the same manner as does the helix member 33, heretofore described, with the exception, that the vanes 48 of structure 44, provide an air flow from blower 39 over the top and downward between and around the outer diameter of structure 44, and the warmed air is pushed out of the mesh screens 21, into the room.

What I now claim is:

1. A flue heat reclaimer for woodburning stoves comprising a helical shaped divider ring adapted to fit over said flue with the inner edge adjacent thereto, said helical divider ring being divided into sections each being semi-circular in configuration, said sections being joined together by arcuate splice plate means, an outer cylindrical housing fitted over said helical divider ring, said housing including a top pair of semi-circular plates and means for mounting said plates to said housing, wherein the upper end of said helical divider ring is mounted to one of said top plates, a thermostatically controlled blower means being mounted on the upper end of said housing, said blower means being mounted to form a double air flow path in the helical divider ring, said housing further including bottom walls and plural air outlet means at the lower end of said housing.

* * * * *